US008269701B2

(12) United States Patent
Chegal

(10) Patent No.: US 8,269,701 B2
(45) Date of Patent: Sep. 18, 2012

(54) ORGANIC LIGHT EMITTING DISPLAY AND METHOD OF DRIVING THE SAME

(75) Inventor: Seung-Won Chegal, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 671 days.

(21) Appl. No.: 12/463,278

(22) Filed: May 8, 2009

(65) Prior Publication Data

US 2009/0278773 A1 Nov. 12, 2009

(30) Foreign Application Priority Data

May 9, 2008 (KR) ..... 10-2008-0043174

(51) Int. Cl.
*G09G 3/30* (2006.01)

(52) U.S. Cl. ..... 345/77; 345/690; 348/674

(58) Field of Classification Search ..... 345/690, 345/89, 77; 348/254, 674
See application file for complete search history.

(56) References Cited

U.S. PATENT DOCUMENTS 5,122,783 A * 6/1992 Bassetti, Jr. ..... 345/690
2006/0145972 A1* 7/2006 Zhang et al. ..... 345/83

FOREIGN PATENT DOCUMENTS

KR 2001-0092306 10/2001
KR 10-2004-0078280 9/2004
KR 10-2006-0039872 5/2006
KR 10-2006-0062411 6/2006
KR 10-2006-0062415 6/2006
KR 10-2006-0113009 11/2006
KR 10-2007-0052381 5/2007

OTHER PUBLICATIONS

KIPO Office action dated May 31, 2010, for priority Korean Patent Application No. 10-2008-0043174, noting the listed references in this IDS.

* cited by examiner

*Primary Examiner* — Kevin M Nguyen
(74) *Attorney, Agent, or Firm* — Christie, Parker & Hale, LLP

(57) ABSTRACT

An organic light emitting display and a driving method thereof, capable of increasing manufacturing yield by widening a range of gamma correction. An exemplary organic light emitting display includes a display region with pixels at crossings of data and scan lines; a gamma correction unit; a gamma correction circuit; a data driver; and a scan driver. The gamma correction unit includes first and second register units for storing first and second gamma correction signals, the second gamma correction signal comprising a corrected first gamma correction signal; a booster unit for correcting the second gamma correction signal to generate a third gamma correction signal; and a multiplexer for selecting the second gamma correction signal or the third gamma correction signal outputted from the booster unit, and for transferring it to the gamma correction circuit.

9 Claims, 3 Drawing Sheets

ORGANIC LIGHT EMITTING DISPLAY AND METHOD OF DRIVING THE SAME

CROSS-REFERENCE TO RELATED APPLICATIONS

This application claims priority to and the benefit of Korean Patent Application No. 10-2008-0043174, filed on May 9, 2008, in the Korean Intellectual Property Office, the entire content of which is incorporated herein by reference.

BACKGROUND

1. Field of the Invention

The present invention relates to an organic light emitting display and a method of driving the same, and more particularly to an organic light emitting display with improved image quality and a method of driving the same.

2. Description of Related Art

Recently, various flat panel display devices having a reduced weight and volume, which are unfavorable aspects of a cathode ray tube, have been developed. Examples of flat panel display devices include liquid crystal displays (LCDs), field emission displays (FEDs), plasma display panels (PDPs), organic light emitting displays, and others.

Among these flat panel display devices, an organic light emitting display displays an image using organic light emitting diodes (OLEDs) that generate light utilizing the recombination of electrons and holes.

An OLED includes an anode electrode, a cathode electrode, and a light emitting layer positioned therebetween. In the OLED, the light emitting layer emits light when current flows in a direction from the anode electrode to the cathode electrode.

Such an organic light emitting display displays the image using characteristics of the OLED. The organic light emitting display includes a plurality of pixels having a plurality of thin film transistors and one or more OLEDs, wherein the amount of current flowing to the OLEDs is controlled by the thin film transistors.

However, variations in manufacturing processes for forming organic light emitting displays may result in varying light emitting layer thicknesses, light emitting layer efficiencies, and characteristics of the thin film transistors. Accordingly, variations in luminance and color across an organic light emitting display may occur. Products with large variations in luminance and color are typically regarded as defective goods and are discarded, thereby causing a reduction in yield.

SUMMARY OF THE INVENTION

Various exemplary embodiments of the present invention include an organic light emitting display and a driving method thereof capable of increasing a yield by widening a range of gamma correction.

An organic light emitting display according to an exemplary embodiment of the present invention includes a display region with pixels at crossings of data lines and scan lines; a gamma correction unit for generating gamma a correction signal; a gamma correction circuit for controlling a gray level voltage corresponding to the gamma correction signal; a data driver for generating data signals corresponding to image signals and to the gray level voltage, and for transferring the data signals to the data lines; and a scan driver for generating scan signals and for transferring the scan signals to the scan lines. The gamma correction unit includes a first register unit for storing a first gamma correction signal; a second register unit for storing a second gamma correction signal, the second gamma correction signal comprising a corrected first gamma correction signal; a booster unit for receiving and correcting the second gamma correction signal stored in the second register unit to generate a third gamma correction signal; and a multiplexer for selecting one signal from the group consisting of the second gamma correction signal stored in the second register unit and the third gamma correction signal outputted from the booster unit, and for transferring the selected signal to the gamma correction circuit.

A method for driving an organic light emitting display according to another exemplary embodiment of the present invention includes adding a first correction value to a first gamma correction signal to correct the first gamma correction signal and to generate a second gamma correction signal; storing the second gamma correction signal; generating a third gamma correction signal by correcting the second gamma correction signal utilizing a second correction value; and outputting a signal selected from the group consisting of the second gamma correction signal and the third gamma correction signal.

The organic light emitting display and a driving method thereof according to various embodiments of the present invention are capable of improving image quality by widening a correction range of a gamma. Also, it is capable of lowering manufacturing costs by increasing production yield.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
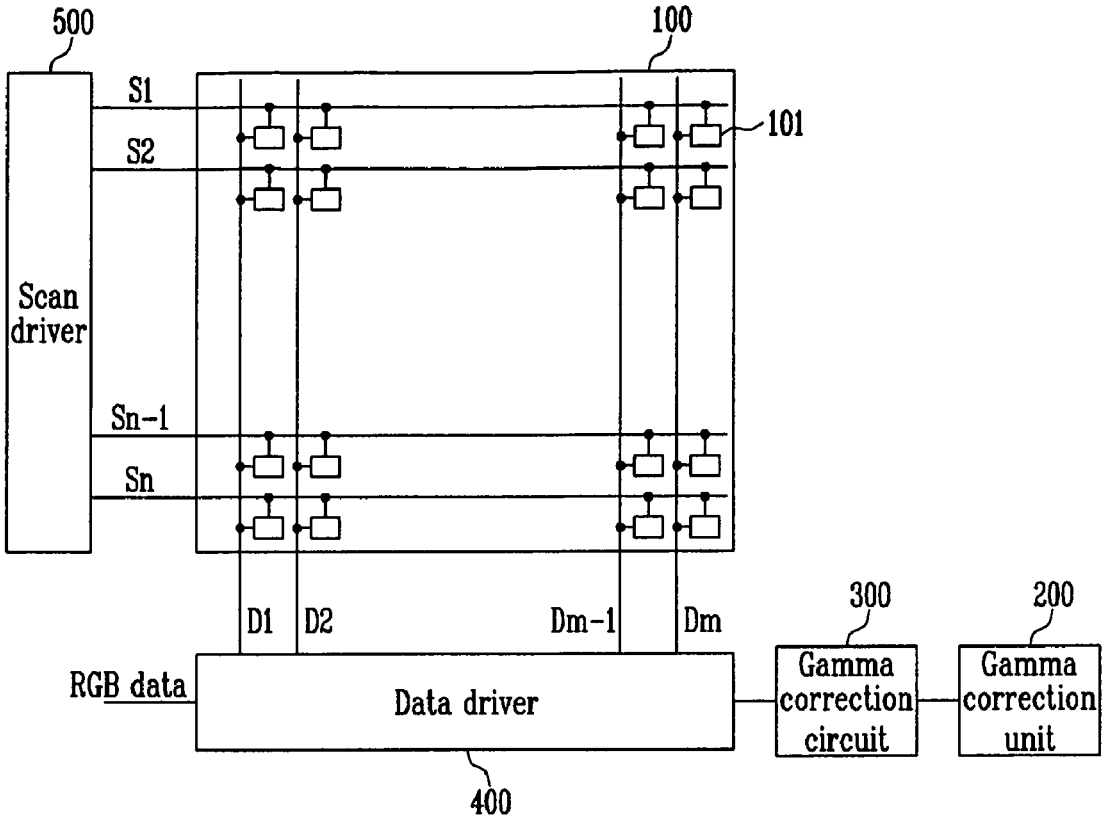
FIG. 1 is a block diagram of an organic light emitting display according to an exemplary embodiment of the present invention.

Hereinafter, certain exemplary embodiments according to the present invention are described with reference to the accompanying drawings. Here, when a first element is described as being coupled to a second element, the first element may be directly coupled to the second element, or may be indirectly coupled to the second element via a third element. Further, some of the elements that are not essential to a complete understanding of the invention are omitted for clarity. Also, like reference numerals refer to like elements throughout.

FIG. 1 is a block diagram of an organic light emitting display according to an exemplary embodiment of the present invention. With reference to FIG. 1, the organic light emitting display according to this embodiment includes a display region 100, a gamma correction unit 200, a gamma correction circuit 300, a data driver 400, and a scan driver 500.

The display region 100 includes a plurality of pixels 101 that each include an OLED (not shown) for emitting light corresponding to the flow of current in each pixel. N scan lines (S1, S2, . . . Sn−1, and Sn) extend in a row direction for transferring scan signals, and m data lines (D1, D2, . . . Dm−1, and Dm) extend in a column direction for transferring data signals.

The display region 100 is driven by receiving first power ELVDD and second power ELVSS from the outside. Accordingly, the display region 100 displays images using the scan signals and the data signals, and generates light by driving a current generated by the first power ELVDD and the second power ELVSS to the organic light emitting diode.

The gamma correction unit 200 generates gamma correction signals according to gamma characteristics of the organic light emitting display and, through the gamma correction circuit 300, applies the gamma correction signals to the data signals. The data signal applied with the gamma correction signal has a ratio of gray levels to luminance with a curve of a logarithmic function or an exponential function.

Since the data signal applied with the gamma correction signal displays an image signal according to the gamma characteristics of the organic light emitting display, it should better correspond to the actually desired color and luminance.

The gamma correction signal is applied with a correction value according to luminance and color displayed in the display region 100. In other words, luminance and color displayed in the display region 100 substantially correspond to the actually desired luminance and color by correcting the gamma correction signal.

The gamma correction unit 200 stores the gamma correction signal applied with the correction value and transfers the stored gamma correction signal to the gamma correction circuit 300, thereby setting a voltage corresponding to each gray level in the gamma correction circuit 300. The data driver 400 transforms the image signal (RGB data) into the data signal by using the voltages set by the gamma correction circuit 300. A detailed description of the gamma correction circuit 300 will be described below with reference to FIG. 3.

Even when the data signal generated by the data driver 400 is corrected by the gamma correction signal, the displayed image may not have the actually desired luminance and color. More specifically, when manufacturing the organic light emitting display, although the same gamma correction signal is applied, the image may appear different from the actually desired luminance and color due to process variations, etc. That is, in the organic light emitting display, because variations may occur in a thickness of the light emitting layer, an efficiency of the light emitting layer, operational characteristics of the thin film transistor, etc., a sufficient correction may not be made by utilizing the same correction value on all displays. Thus, during production, a correction value may be applied to the corrected gamma correction signal once more to enable implementation of a wide correction range.

The data driver 400 generates data signals using the image signal (RGB data) and the gamma correction signal from the gamma correction circuit 300. The data driver 400 is coupled to the data lines D1, D2, . . . Dm−1, and Dm of the display region 100 to apply the generated data signals to the display region 100.

The scan driver 500, which generates scan signals, is coupled to the scan lines S1, S2, . . . Sn−1, and Sn to transfer the scan signals to respective rows of the display region 100. The data signal output from the data driver 400 is transferred to the pixel 101 receiving the scan signal so that a driving current is generated, wherein the generated driving current flows to the OLED.

Figure 2:
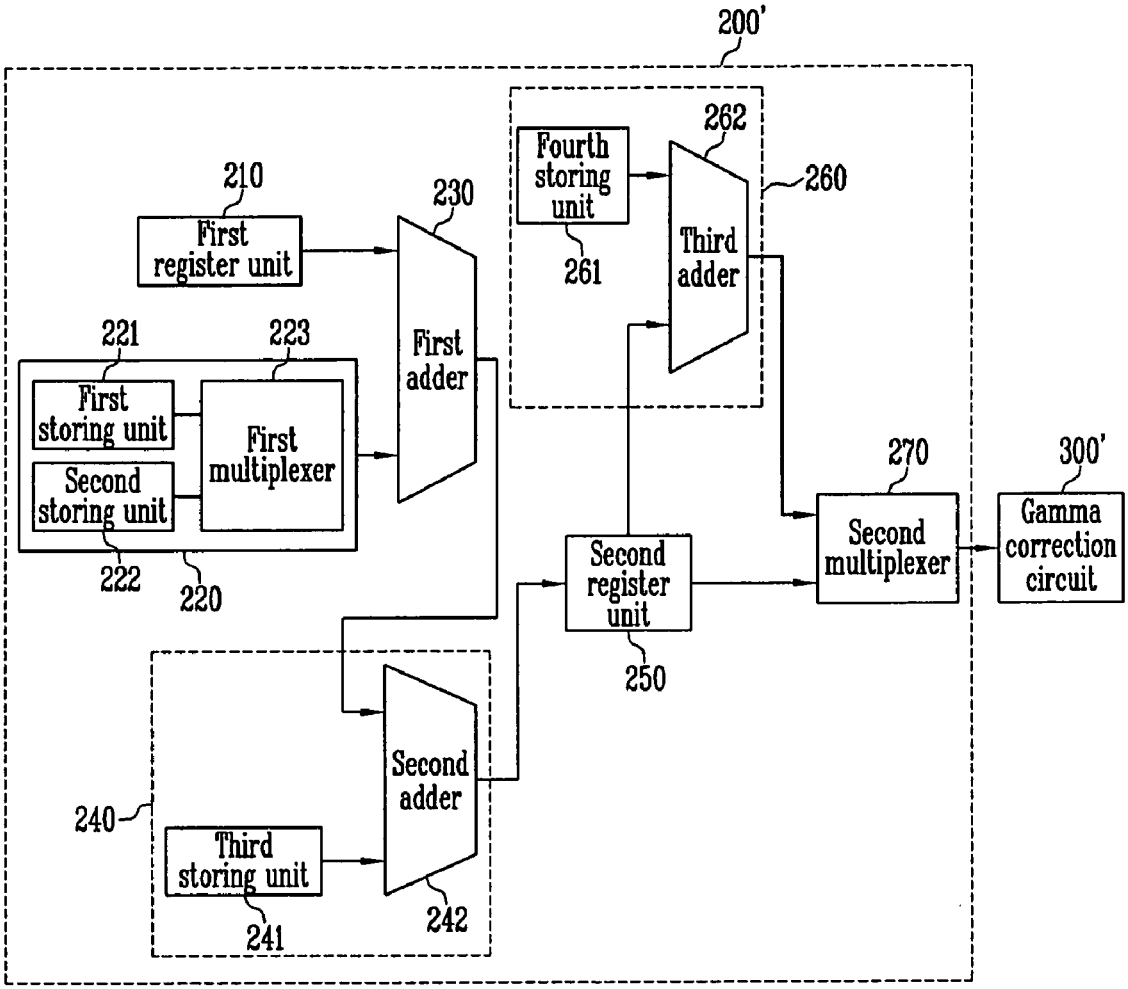
FIG. 2 is a block diagram of a gamma correction unit according to an exemplary embodiment of the present invention.

FIG. 2 is a block diagram of a gamma correction unit 200' according to an exemplary embodiment of the present invention. In certain embodiments, the gamma correction unit 200' may be utilized in the place of the gamma correction unit 200 of FIG. 1. Referring to FIG. 2, the gamma correction unit 200' includes a first register unit 210, an offset unit 220, a first adder 230, a correction unit 240, a second register unit 250, a booster unit 260, first to fourth storing units 221, 222, 241, and 261, a first multiplexer 223, and a second multiplexer 270. The output of the second multiplexer is sent to the gamma correction circuit 300'. In some embodiments, the gamma correction circuit 300' may be utilized as the gamma correction circuit 300 of FIG. 1.

The first register unit 210 stores a first gamma correction signal for generating light having a brightness corresponding to each gray level according to the characteristics of the OLEDs and the organic light emitting display. In the case of a display with 64 gray levels, the first gamma correction signal utilizes a voltage of an upper level and voltage of a lower level to generate 64 voltages V0, V1 . . . V62, and V63.

The offset unit 220 changes the first gamma correction signal in the first register unit 210. The offset unit 220 includes the first storing unit 221 and the second storing unit 222, wherein each of the first storing unit 221 and the second storing unit 222 stores offset values. That is, a first offset value stored in the first storing unit 221 is utilized to correct the first gamma correction signal stored in the first register unit 210, or a second offset value stored in the second storing unit 222 is utilized to correct the first gamma correction signal stored in the first register unit 210, as selected by the first multiplexer 223.

Therefore, in an exemplary embodiment utilizing 64 gray levels, the 64 voltages generated according to the first offset value stored in the first storing unit 221 have different values than the 64 voltages generated according to the second offset value in the second storing unit 222. The offset unit 220 further includes the first multiplexer 223, and outputs one of the offset values stored in the first storing unit 221 and the second storing unit 222 by the operation of the first multiplexer 223. The offset value is utilized to control an offset of the highest level voltage and the lowest level voltage. Therefore, a difference in a slope occurs between a second gamma correction signal, to which the offset value was applied, and the first gamma correction signal.

The first adder 230 adds the first gamma correction signal stored in the first register unit 210 to the offset value output from the offset unit 220 to correct the first gamma correction signal, thereby generating a second gamma correction signal. That is, the first gamma correction signal is corrected by the offset value by utilizing the first adder 230 to generate the second gamma correction signal.

The correction unit 240 performs a role of further correcting the second gamma correction signal corrected by the offset unit 220 to allow the second gamma correction signal to be more accurately corrected. The correction unit 240 includes the third storing unit 241 for storing a correction value and a second adder 242 for adding the second gamma correction signal output from the first adder 230 and the correction value stored in the third storing unit 241. The correction value is set during production by a designer after assessing the color sense and brightness of an image displayed in the display region. The correction unit 240 adds the second gamma correction signal to the correction value utilizing the second adder 242 to generate a third gamma correction signal.

The second register unit 250 stores the third gamma correction signal generated in the correction unit 240. The third gamma correction signal stored in the second register unit 250 is transferred to the booster unit 260 and the second multiplexer 270.

The booster unit 260 receives the third gamma correction signal from the second register unit 250. The booster unit 260 includes the fourth storing unit 261 for storing a second correction value. In some embodiments, the second correction value stored in the fourth storing unit 261 is the same correction value as the correction value set in the correction unit 240. The booster unit 260 further includes a third adder 262 for adding the third gamma correction signal to the correction value stored in the fourth storing unit 261. Therefore, the booster unit 260 corrects the third gamma correction signal using the correction value stored in the fourth storing unit 261 to generate a fourth gamma correction signal. That is, the third gamma correction signal stored in the second register unit 250 is corrected once more, so that a correction range of the image is further widened.

The second multiplexer 270 selects one of either the third gamma correction signal stored in the second register unit 250 or the fourth gamma correction signal from the booster unit 260 to transfer to the gamma correction circuit 300'. That is, in the case where a correction result from the correction unit 240 is sufficient, the second multiplexer 270 outputs the third gamma correction signal stored in the second register unit 250. In the case where the correction result corrected in the correction unit 240 is not sufficient, the second multiplexer 270 outputs the fourth gamma correction signal output from the booster unit 260. In one embodiment, the decision to transfer the third gamma correction signal or the fourth gamma correction signal to the gamma correction circuit 300' is also made by the designer during production.

Figure 3:
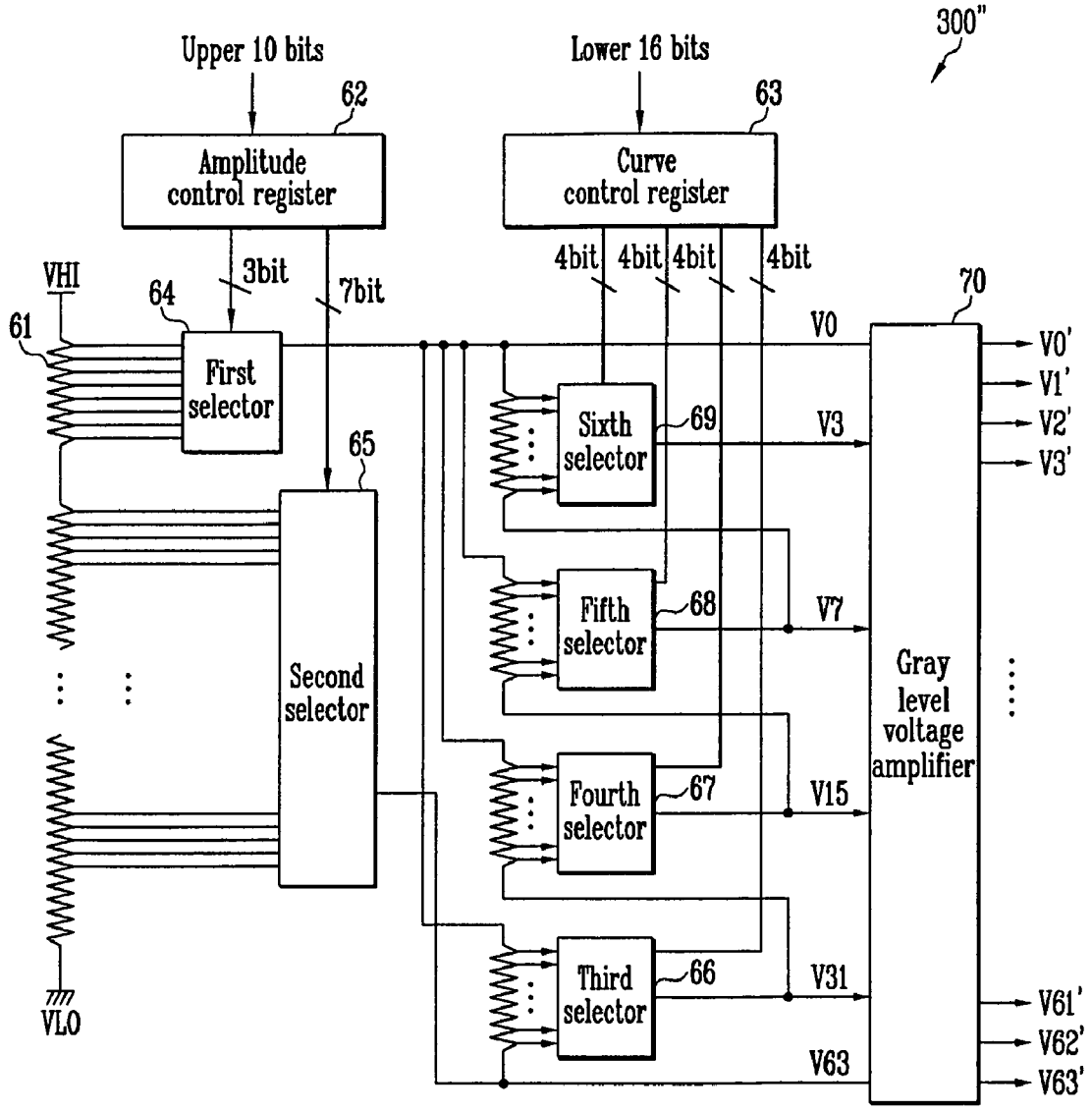
FIG. 3 is a block diagram of a gamma correction circuit shown in FIG. 2.

FIG. 3 is a block diagram of a gamma correction circuit 300" according to an exemplary embodiment of the present invention in which 64 gray level voltages are utilized. In some embodiments, the gamma correction circuit 300" may be utilized as the gamma correction circuit 300' shown in FIG. 2 or as the gamma correction circuit 300 shown in FIG. 1. Referring to FIG. 3, the gamma correction circuit 300" includes a ladder resistor 61, an amplitude control register 62, a curve control register 63, first through sixth selectors 64 through 69, and a gray level voltage amplifier 70.

The ladder resistor 61 defines the highest level voltage VHI supplied from the outside as a reference voltage and includes a plurality of variable resistors coupled in series between the lowest level voltage VLO and the reference voltage VHI. A plurality of gray level voltages are generated through the ladder resistor 61. Also, when making a value of the ladder resistor small, an amplitude control range becomes narrow, whereas an amplitude control accuracy increases. On the other hand, when making the value of the ladder resistor large, an amplitude control range becomes wide, whereas an amplitude control accuracy decreases.

In the described embodiment, the gamma correction signal from the gamma correction unit 200 includes 26 bits, wherein the upper 10 bits are input to the amplitude control register 62 and the lower 16 bits thereof are input to the curve control register 63 and selected as register setting values.

The amplitude control register 62 receives the signal of the upper 10 bits, outputs 3 bits of the upper 10 bits of the gamma correction signal to the first selector 64, and outputs the remaining 7 bits of the upper 10 bits of the gamma correction signal to the second selector 65. At this time, it is possible to increase the number of selectable gray levels by increasing the number of setting bits.

The curve control register 63 receives the lower 16 bits of the gamma correction signal, and outputs 4 bits of the lower 16 bits of the gamma correction signal to each of the respective third through sixth selectors 66 to 69.

The first selector 64 selects a gray level voltage V0 from among the plurality of gray level voltages distributed through the ladder resistor 61, the gray level voltage V0 corresponding to a value of 3 bits of the gamma correction signal stored in the amplitude control register 62, to output as the highest gray level voltage.

The second selector 65 selects a gray level voltage V63 from among the plurality of gray level voltages distributed through the ladder resistor 61, the gray level voltage V63 corresponding to a value of 7 bits of the gamma correction signal stored in the amplitude control register 62, to output as the lowest gray level voltage.

The third selector 66 distributes the gray level voltage V0 output from the first selector 64 and the gray level voltage V63 output from the second selector 65 into a plurality of gray level voltages through a plurality of resistor columns, and selects and outputs a gray level voltage V31 corresponding to a value of 4 bits of the gamma correction signal.

The fourth selector 67 selects and outputs a gray level voltage V15 corresponding to a value of 4 bits of the gamma correction signal from among the gray level voltages between the output of the first selector 64 and the output of the third selector 66.

The fifth selector 68 selects and outputs a gray level voltage V7 corresponding to a value of 4 bits of the gamma correction signal from among the gray level voltages between the output of the first selector 64 and the output of the fourth selector 67.

The sixth selector 69 selects and outputs a gray level voltage V3 corresponding to a value of 4 bits of the gamma correction signal from among a plurality of gray level voltages between the output of the first selector 64 and the output of the fifth selector 68.

With operation as described above, it is possible to control gamma characteristics to suit characteristics of each light emitting display by enabling curve control of an intermediate gray level unit according to a register setting value of the curve control register 63. Also, when it is intended to make the gamma curve characteristics concave, as a lower gray level is displayed, a potential difference between each gray level is set to be larger. On the other hand, when it is intended to make gamma curve characteristics convex, as a lower gray level is displayed, potential difference between each gray level is set to be smaller.

The gray level voltage amplifier 70 outputs a plurality of gray level voltages V0', V1', . . . V63', corresponding to each of the gray levels to be displayed in the display region 100.

In an exemplary embodiment of the present invention, the above-mentioned operation is performed by installing a gamma correction circuit as described above for each of R, G, and B groups so that R, G, and B light emitting devices obtain substantially the same brightness, in consideration of variations in the characteristics of each of the R, G, and B light emitting devices themselves. Thereby, it is possible to differently set the amplitude and curve through the curve control register 63 and the amplitude control register 62 by R, G, and B.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a display region including pixels at crossings of data lines and scan lines;

a gamma correction unit for generating a gamma correction signal;

a gamma correction circuit for controlling a gray level voltage corresponding to the gamma correction signal;

a data driver for generating data signals utilizing image signals and the gray level voltage, and for transferring the data signals to the data lines; and a scan driver for generating scan signals and for transferring the scan signals to the scan lines, wherein the gamma correction unit comprises:

a first register for storing a first gamma correction signal;

a second register for storing a second gamma correction signal, the second gamma correction signal comprising a corrected first gamma correction signal;

a booster for receiving and correcting the second gamma correction signal stored in the second register to generate a third gamma correction signal; and a multiplexer for selecting the second gamma correction signal stored in the second register or the third gamma correction signal outputted from the booster, and for transferring the selected signal to the gamma correction circuit.

2. The organic light emitting display as claimed in claim 1, further comprising:

an offset value storage for storing an offset value; and a first adder for adding the offset value with the first gamma correction signal to generate a fourth gamma correction signal.

3. The organic light emitting display as claimed in claim 2, further comprising:

a first storage for storing a first correction value; and a second adder for adding the first correction value with the fourth gamma correction signal to generate the second gamma correction signal.

4. The organic light emitting display as claimed in claim 3, further comprising:

a second storage for storing a second correction value; and a third adder for adding the second correction value with the second gamma correction signal to generate the third gamma correction signal.

5. The organic light emitting display as claimed in claim 4, wherein the first correction value is a same value as the second correction value.

6. The organic light emitting display as claimed in claim 4, wherein the fourth gamma correction signal and the first gamma correction signal are different in slope by the offset value.

7. A method for driving an organic light emitting display, comprising:

adding a first correction value to a first gamma correction signal to correct the first gamma correction signal and to generate a second gamma correction signal;

storing the second gamma correction signal;

generating a third gamma correction signal by correcting the second gamma correction signal utilizing a second correction value; and selectively outputting the second gamma correction signal or the third gamma correction signal.

8. The method as claimed in claim 7, wherein the first correction value is a same value as the second correction value.

9. The method as claimed in claim 7, wherein said generating the second gamma correction signal comprises generating a fourth gamma correction signal applied with an offset value changing a slope of the first gamma correction signal and then generating the second gamma correction signal by applying the first correction value to the fourth gamma correction signal.

* * * * *